US007465096B2

(12) United States Patent
Dick et al.

(10) Patent No.: US 7,465,096 B2
(45) Date of Patent: Dec. 16, 2008

(54) EARTH BORING BIT WITH TILTED HYDRODYNAMIC THRUST BEARING

(75) Inventors: Aaron J. Dick, Houston, TX (US); Chih Lin, Spring, TX (US)

(73) Assignee: Baker Hughes Incorporated, Houston, TX (US)

( * ) Notice: Subject to any disclaimer, the term of this patent is extended or adjusted under 35 U.S.C. 154(b) by 207 days.

(21) Appl. No.: 11/248,623

(22) Filed: Oct. 12, 2005

(65) Prior Publication Data

US 2007/0081747 A1 Apr. 12, 2007

(51) Int. Cl.
*F16C 33/00* (2006.01)
*F16C 33/66* (2006.01)
*E21B 10/22* (2006.01)

(52) U.S. Cl. ..... 384/95; 384/93; 384/96; 175/327; 175/372

(58) Field of Classification Search ..... 384/92–96, 384/114, 124; 175/368–372, 228
See application file for complete search history.

(56) References Cited

U.S. PATENT DOCUMENTS 1,801,720 A * 4/1931 Bull ..... 384/96
2,654,577 A * 10/1953 Green ..... 384/96
2,814,465 A * 11/1957 Green ..... 384/93
3,361,494 A * 1/1968 Galle ..... 384/96
4,187,743 A * 2/1980 Thomas ..... 76/108.2
4,258,806 A 3/1981 Kunkel et al.
4,491,428 A * 1/1985 Burr et al. ..... 384/93
4,516,641 A * 5/1985 Burr ..... 384/94
4,600,064 A * 7/1986 Scales et al. ..... 175/368
4,875,532 A * 10/1989 Langford, Jr. ..... 175/371
5,265,964 A 11/1993 Hooper
5,307,887 A * 5/1994 Welsh ..... 384/94
5,586,611 A * 12/1996 Dorosz ..... 175/369
5,593,231 A * 1/1997 Ippolito ..... 384/95
5,944,125 A * 8/1999 Byrd ..... 384/93
6,220,374 B1 * 4/2001 Crawford ..... 175/372
6,460,635 B1 10/2002 Kaisi et al.

FOREIGN PATENT DOCUMENTS

GB 1137342 12/1968
GB 2117430 10/1983

OTHER PUBLICATIONS

*Fundamentals of Fluid Film Lubrication*, McGraw-Hill, Inc. by Bernard J. Hamrock, pp. 172-174 and cover.

* cited by examiner

*Primary Examiner*—Marcus Charles
(74) *Attorney, Agent, or Firm*—Bracewell & Giuliani LLP

(57) ABSTRACT

An earth boring bit has thrust faces with one of the thrust faces being at least partially tilted relative to the other. The bit has a cone rotatably mounted to a bearing pin of the bit body. The thrust faces are in the cone and on an end of the bearing pin. One of the thrust faces is completely flat and perpendicular to the axis of the bearing pin. The other thrust face has a tilted portion that is at a skewed angle relative to the axis. The tilted portion creates converging and diverging zones between the thrust faces.

20 Claims, 2 Drawing Sheets

Fig. 1
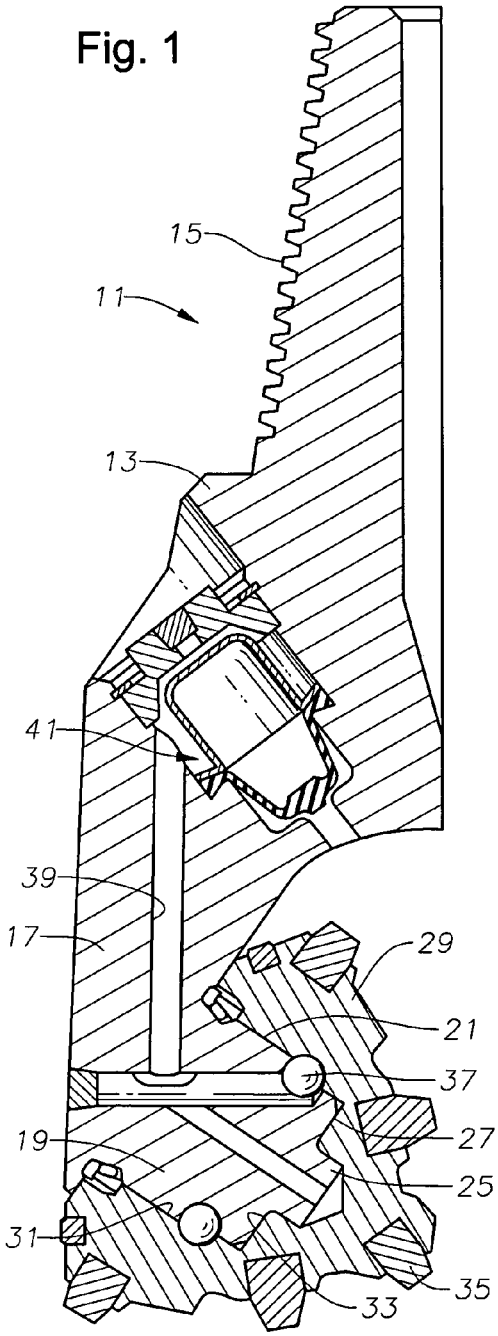
Fig. 2
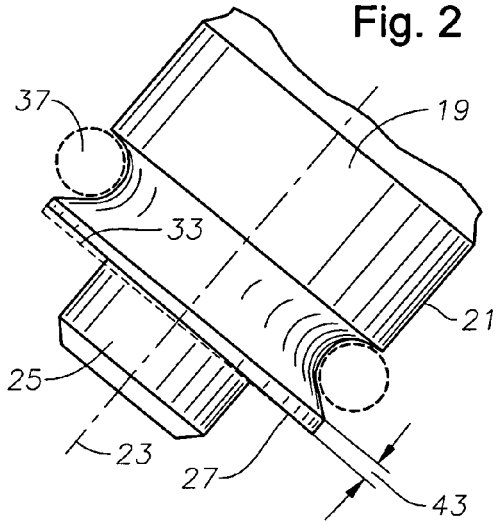
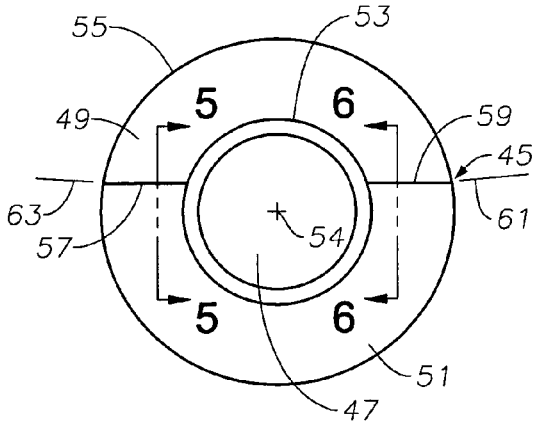
Fig. 3

EARTH BORING BIT WITH TILTED HYDRODYNAMIC THRUST BEARING

FIELD OF THE INVENTION

This invention relates in general to rolling cone earth boring bits, and in particular to an earth boring bit having thrust faces between a bearing pin and a cone, one of the thrust faces being at least partially tilted relative to the other.

BACKGROUND OF THE INVENTION

One type of earth boring bits for drilling oil and gas wells has a bit body with at least one rolling cone, typically three. Each cone is mounted on a cylindrical bearing pin that depends downward and inward from a bit leg of the bit body. Annular thrust faces are formed on the bearing pin and in the cone cavity for reacting against downward thrust. The bearing pin thrust face is in a plane nominally perpendicular to an axis of the bearing pin. The cone thrust face is formed in a plane nominally perpendicular to the rotational axis of the cone. Initially, the thrust faces are parallel to each other. Lubricant is supplied from a lubricant reservoir to the spaces between the bearing pin and the cone.

While the bit is drilling, the thrust faces typically do not run precisely parallel to each other. The bearing pin deflects slightly because it is cantilevered from the bit leg. Also, because of tolerances between the cylindrical portions of the cone and the bearing pin, the cone can cock slightly relative to the bearing pin. This slight misalignment of the cone axis relative to the bearing pin axis results in a circumferentially converging-diverging space between the thrust faces, which can be beneficial because it can create hydrodynamic lubricant pressure between the thrust faces to help support the load. However, the bearing misalignment also concentrates thrust bearing contact loads, which is detrimental.

SUMMARY OF THE INVENTION

In this invention, a rolling cone boring bit has a bearing pin and cone with mating thrust faces. Either the cone or the bearing pin has its thrust face formed with at least a portion tilted relative to its axis. This defines between the thrust faces a diverging clearance area followed by converging clearance area for enhancing a lubricant film.

The tilted portion may comprise the entire thrust face. Alternately, it may comprise only a portion, with the remaining portion of the thrust face being perpendicular to the axis of rotation. If so, the tilted portion of the thrust face is at a very small angle relative to the remaining or parallel portion of the thrust face. In the preferred embodiment, the tilted thrust face is located on the bearing pin.

BRIEF DESCRIPTION OF THE DRAWINGS

FIG. 1 is a quarter, vertical sectional view illustrating a portion of an earth boring bit having thrust faces constructed in accordance with this invention.

FIG. 2 is an enlarged side elevational view of the bearing pin of FIG. 1, shown with a tilted face that is exaggerated.

FIG. 3 is an end view of a bearing pin having an alternate embodiment of a thrust face.

DETAILED DESCRIPTION OF THE INVENTION

Figure 4:
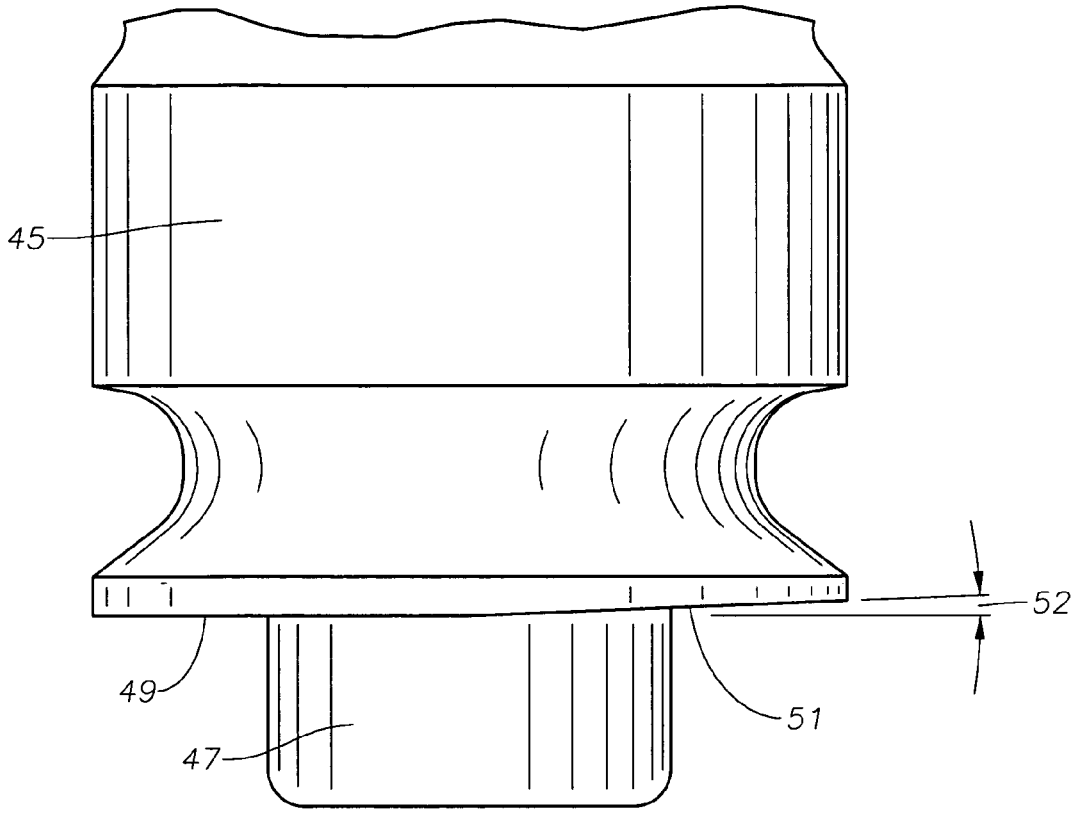
FIG. 4 is a side elevational view of the bearing pin of FIG. 3.

Referring to FIG. 1, bit 11 has a body 13 with a threaded pin 15 on its upper end for connection to a drill string (not shown). Body 13 typically has three bit legs 17 (only one shown), each having a depending bearing pin 19. Bearing pin 19 inclines downward and inward toward an axis of rotation (not shown) of body 13.

Bearing pin 19 has a cylindrical surface 21 that is concentric with a bearing pin axis 23 (FIG. 2). In this embodiment, the inward end of bearing pin 19 has a nose 25. Nose 25 is cylindrical and has a smaller diameter than cylindrical bearing surface 21. An annular bearing pin thrust face 27 is formed on a shoulder joining nose 25 to cylindrical surface 21. A cone 29 has a cavity with a cylindrical portion 31 that fits around cylindrical bearing surface 21 of bearing pin 19. Cone 29 rotates on bearing pin 19 about its axis, which nominally coincides with bearing pin axis 23. Cone 29 has an annular thrust face 33 within its cavity that faces upward and outward and is in dynamic engagement with bearing pin thrust face 27.

Cone 29 has a plurality of cutting elements 35 on its exterior. Cutting elements 35 may be tungsten carbide inserts press-fitted into holes in the body of cone 29. Alternately, cutting elements 35 could be teeth milled into the exterior surface of the body of cone 29. Cone 29 is retained conventionally on bearing pin 19, which in this example is by a plurality of balls 37. Balls 37 engage mating grooves formed in cone 29 and on bearing pin 19. Lubricant passages 39 supply lubricant or grease to the spaces between cylindrical surfaces 21 and 31 and between thrust faces 27 and 33. A pressure compensator 41 reduces the pressure differential between the lubricant within passages 39 and drilling fluid pressure on the exterior of bit 11.

Thrust faces 27, 33 may have conventional coatings to reduce friction and increase the operating life. One of the thrust faces 27, 33 has at least a portion that is tilted relative to the other thrust face. In the example of FIG. 2, cone thrust face 33 is conventional and located in a single plane nominally perpendicular to the axis of rotation of cone 29. The entire bearing pin thrust face 27 is skewed slightly relative to bearing pin axis 23. That is, although flat and located in a single plane, bearing pin thrust face 27 is inclined at a small angle 43 relative to a plane perpendicular to bearing pin axis 23. This places bearing pin thrust face 27 at angle 43 relative to cone thrust face 33, shown by the dotted lines in FIG. 2, prior to any load due to operation of bit 11.

The slight misalignment results in a point of maximum separation and a point of minimum separation between thrust faces 27, 33. The points of maximum and minimum separation will be 180 degrees apart from the other. The slight misalignment of thrust faces 27, 33 creates converging and diverging zones as cone 29 rotates, tending to cause lubricant to wedge into the converging zone, which enhances a lubricant film. In the preferred embodiment, angle 43 is in the range from about 0.05 to 0.5 degrees.

In the embodiment of FIGS. 3-6, only a segment of one of the thrust faces is tilted. Referring to FIG. 3, bearing pin 45 has a nose 47 as in the first embodiment. The bearing pin thrust face has a parallel portion 49 and a tilted portion 51. Both portions 49 and 51 are flat in this embodiment, but tilted portion 51 is at an angle 52 (FIG. 4) relative to parallel portion 49. Angle 52 is preferably in the range from about 0.05 to 15 degrees, and from 0.05 to 0.5 degrees in one embodiment. That embodiment has a two-inch outer diameter 55 of bearing pin 45. Parallel portion 49 is nominally perpendicular to bearing pin axis 54 (FIG. 3). Tilted portion 51 could be curvilinear rather than flat.

Bearing pin thrust face parallel portion 49 and tilted portion 51 each have inner diameter portions that join each other to make up the inner diameter 53 of the thrust face of bearing pin 45. Similarly, parallel portion 49 and tilted portion 51 each have outer diameter portions that join each other to make up the outer diameter 55 of the thrust face of bearing pin 45. Parallel portion 49 joins tilted portion 51 at a first junction 57 that extends in a straight line from inner diameter 53 to outer diameter 55. Another junction 59 extends from inner diameter 53 to outer diameter 55 and is located a selected circumferential distance from junction 57. Junctions 57, 59 could be rounded rather than sharp lines. In this embodiment, junctions 59 and 57 are located on a common straight line, although they could be located on separate radial lines. In this example, a radial line 61 passes through the intersection of junction 59 with outer diameter 55 at an angle relative to junction 59. A radial line 63 passes through the intersection of junction 57 with outer diameter 55 at an angle relative to junction 57. Junction 57 is at the same angle relative to radial line 63 as junction 59 is to radial line 61.

Tilted portion 51 extends clockwise from radial line 61 to radial line 63, as viewed in FIG. 3. Parallel portion 49 extends clockwise from radial line 63 to radial line 61. In this example, tilted portion 51 extends farther and thus has a greater surface area than parallel portion 49. Preferably, the ratio of the surface area of tilted portion 49 to the entire thrust face of bearing pin 45 in this embodiment is in the range from approximately 25% to 75%, thus the clockwise circumferential distance from radial line 61 to radial line 63 is from 75 to 270 degrees.

Figure 5:
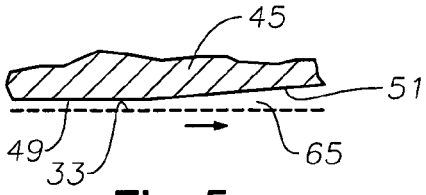
FIG. 5 is an enlarged sectional view of the thrust face of the bearing pin of FIG. 3, taken along the line 5-5 of FIG. 3.
Figure 6:
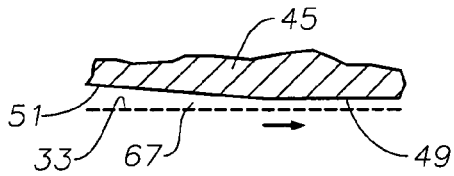
FIG. 6 is an enlarged sectional view of the thrust face of the bearing pin of FIG. 3, taken along the line 6-6 of FIG. 3.

Referring to FIG. 5, junction 57 commences at the beginning of a diverging zone 65, considering the direction of rotation indicated by the arrow in FIG. 5. The lubricant in diverging zone 65 encounters an increasing clearance between cone thrust face 33 and tilted portion 51. Referring to FIG. 6, junction 59 defines a converging zone 67, wherein the clearance between cone thrust face 33 and tilted portion 51 becomes gradually less. The rotation of cone thrust face 33 tends to force lubricant into the wedge-shaped converging zone 67, enhancing a film of lubricant between parallel portion 49 and cone thrust face 33.

The invention has significant advantages. The tilt between the thrust faces enhances a lubricant film due to the converging and diverging zones even though the cone and bearing pin remain concentric within tolerances. The lubricant film reduces torque and improves the life of the bearing surfaces. The parallel portion, if employed in conjunction with the tilted portion, reduces contact forces.

While the invention has been shown in only two of its forms, it should be apparent to those skilled in the art that it is not so limited thus susceptible to various changes without departing from the scope of the invention. For example, the tilted thrust bearing surface could be on the cone rather than on the bearing pin. Also, rather than formed directly on the bearing pin or in the cone, a washer with a tilted thrust bearing surface on one side could be placed between the bearing pin thrust surface and the cone thrust surface. The washer could be secured to the bearing pin against rotation, in which case, it would be considered to be the thrust face of the bearing pin. The washer could be secured to the cone for rotation therewith, in which case, it would be considered to be the thrust face of the cone. The washer could be free of restraint against rotation and have tilted surfaces on both sides, in which case one side could be considered to be a thrust face of the bearing pin and the other side a thrust face of the cone.

The invention claimed is:

1. An earth boring bit, comprising:

a bit body having a bit leg;

a bearing pin having a cylindrical bearing surface concentric with a bearing pin axis;

a cone mounted to the bearing pin member for rotation about the bearing pin about the axis;

a thrust face in dynamic engagement with a thrust surface, the thrust surface being in a single plane nominally perpendicular to the axis, the thrust face and thrust surface being located between the bearing pin and the cone; and the thrust face having a tilted portion, defining between the tilted portion and the thrust surface a diverging clearance area rotationally followed by a converging clearance area for enhancing a lubricant film, the tilted portion being in a single plane tilted relative to a plane perpendicular to the axis.

2. The bit according to claim 1, wherein: the tilted portion comprises a flat surface.

3. The bit according to claim 1, wherein the thrust surface is integrally formed in the cone.

4. The bit according to claim 1, wherein the tilted portion comprises 100 percent of the thrust face.

5. The bit according to claim 1, wherein the tilted portion comprises less than 100 percent of the thrust face.

6. The bit according to claim 1, wherein the tilted portion comprises 25 to 100 percent of the thrust face.

7. The bit according to claim 1, wherein:

the thrust face has an inner diameter and an outer diameter;

the thrust face has a parallel portion that extends from the outer diameter to the inner diameter partially around said the thrust face, the parallel portion being in a single plane; and the tilted portion of the thrust face extends from the outer diameter to the inner diameter for the remaining portion of the thrust face.

8. The bit according to claim 1, wherein the thrust face is integrally formed on the bearing pin.

9. The bit according to claim 1, wherein the tilted portion is tilted in the range from 0.05 to 0.5 degrees.

10. An earth boring bit, comprising:

a bit body having a bit leg with a depending bearing pin extending along a bearing pin axis;

a cone rotationally mounted to the bearing pin;

an annular first thrust bearing surface on a selected one of the cone and the bearing pin, the first thrust bearing surface being flat and nominally perpendicular to the axis;

an annular second thrust bearing surface on the other of the cone and the bearing pin in dynamic engagement with the first thrust bearing surface;

the second thrust bearing surface having a tilted portion that is inclined on a single plane relative to the first thrust bearing surface, the tilted portion extending from an inner diameter to an outer diameter of the second thrust bearing surface for a selected circumferential distance; and the second thrust bearing surface having a parallel portion that is a parallel to the first thrust bearing surface.

11. The bit according to claim 10, wherein the tilted portion of the second thrust bearing surface comprises a flat surface.

12. The bit according to claim 10, wherein a converging zone and a diverging zone are located between the tilted portion and the first bearing surface.

13. The bit according to claim 10, wherein the tilted portion comprises 25 to 100 percent of the second thrust bearing surface.

14. The bit according to claim 10, wherein the second thrust bearing surface is located on the bearing pin.

15. The bit according to claim 10, wherein the tilted portion is at an angle in the range from 0.05 to 0.5 degrees relative to the parallel portion.

16. An earth boring bit, comprising:

a bit body having a bit leg with a depending bearing pin;

a cone mounted to the bearing pin for rotation relative to the bearing pin about a bearing pin axis;

an annular bearing pin thrust face on the bearing pin, the bearing pin thrust face having a parallel portion that is flat, nominally perpendicular to the axis, and extends partially around a circumference of the bearing pin thrust face, the bearing pin thrust face having a tilted portion that is flat, at an angle relative to the axis, and extends around a remaining portion of the circumference; and an annular cone thrust face in the cone in dynamic engagement with the bearing pin thrust face, the cone thrust face being flat and nominally perpendicular to the axis.

17. The bit according to claim 16, wherein the angle of the tilted portion is in the range from 0.05 to 0.5 degrees relative to the parallel portion.

18. The bit according to claim 16, wherein the tilted portion extends around the circumference a distance in a range from about 90 degrees to 270 degrees.

19. The bit according to claim 16, wherein a junction of the tilted portion with the parallel portion defines a line extending from an inner diameter to an outer diameter of the bearing pin thrust face.

20. The bit according to claim 16, wherein the tilted portion joins the parallel portion at two junctions, the junctions being located on a common straight line.

* * * * *

UNITED STATES PATENT AND TRADEMARK OFFICE

CERTIFICATE OF CORRECTION

PATENT NO. : 7,465,096 B2
APPLICATION NO. : 11/248623
DATED : December 16, 2008
INVENTOR(S) : Aaron J. Dick et al.

It is certified that error appears in the above-identified patent and that said Letters Patent is hereby corrected as shown below:

In the Claims:

Claim 7:

Column 4, line 35, delete "said" before "the thrust face,"

Signed and Sealed this

Thirty-first Day of March, 2009

John Doll

JOHN DOLL
*Acting Director of the United States Patent and Trademark Office*